US006049064A

United States Patent [19]

Natsuhara et al.

[11] Patent Number: 6,049,064

[45] Date of Patent: Apr. 11, 2000

[54] HEAT FIXING DEVICE FOR FIXING A TONER IMAGE

[75] Inventors: Masuhiro Natsuhara; Hirohiko Nakata, both of Hyogo, Japan

[73] Assignee: Sumitomo Electric Industries, Ltd., Osaka, Japan

[21] Appl. No.: 08/940,635

[22] Filed: Sep. 30, 1997

[30] Foreign Application Priority Data

Oct. 28, 1996 [JP] Japan ..... 8-285096

[51] Int. Cl.[7] ..... H05B 1/00

[52] U.S. Cl. ..... 219/216; 219/469

[58] Field of Search ..... 219/469, 470, 219/471, 216, 388; 355/282, 285, 286, 289, 295; 430/60; 118/60

[56] References Cited

U.S. PATENT DOCUMENTS

| | | | |
|---|---|---|---|
| 5,001,089 | 3/1991 | Kasori et al. | 501/96 |
| 5,051,784 | 9/1991 | Yamamoto et al. | 355/285 |
| 5,162,634 | 11/1992 | Kusaka et al. . | |
| 5,241,155 | 8/1993 | Koh et al. . | |
| 5,278,618 | 1/1994 | Mitani et al. . | |
| 5,365,314 | 11/1994 | Okuda et al. . | |
| 5,376,773 | 12/1994 | Masuda et al. | 219/543 |
| 5,499,087 | 3/1996 | Hiroaka et al. . | |
| 5,660,750 | 8/1997 | Kusaka . | |
| 5,732,318 | 3/1998 | Natsuhara et al. . | |
| 5,860,052 | 1/1999 | Ohtsuka et al. . | |

FOREIGN PATENT DOCUMENTS

| | | |
|---|---|---|
| 0372479 A1 | 6/1990 | European Pat. Off. . |
| 0604977 A2 | 7/1994 | European Pat. Off. . |
| 0632344 A2 | 1/1995 | European Pat. Off. . |
| 0668549 A2 | 8/1995 | European Pat. Off. . |
| 63-313182 | 12/1988 | Japan . |
| 1-263679 | 10/1989 | Japan . |
| 2-157878 | 6/1990 | Japan . |
| 03089482 | 4/1991 | Japan . |
| 05135849 | 6/1993 | Japan . |
| 07201455 | 8/1995 | Japan . |
| 09080940 | 3/1997 | Japan . |
| 09197861 | 7/1997 | Japan . |

*Primary Examiner*—Mark Paschall
*Assistant Examiner*—Thor Campbell
*Attorney, Agent, or Firm*—W. G. Fasse; W. F. Fasse

[57] ABSTRACT

A heat insulating layer is provided between the stay and the ceramics heater in a heat fixing device. The heat conductivity of the heat insulating layer is lower than that of the stay. The heater includes a heating element provided on an aluminum nitride substrate. The heater is especially arranged with the heating element facing toward the stay, and with the substrate facing away from the stay and contacting a heat transfer film for conducting heat to a paper sheet or the like on which a toner image is to be fixed.

18 Claims, 11 Drawing Sheets

HEAT FIXING DEVICE FOR FIXING A TONER IMAGE

BACKGROUND OF THE INVENTION

1. Field of the Invention

The present invention relates to a heat fixing device, and more specifically, it relates to a heat fixing device for fixing a toner image which is formed on a surface of a transfer material such as paper held and moved between a heat-resistant film and a pressure roller by pressurization with the pressure roller and heating with a ceramics heater through the heat-resistant film.

2. Description of the Background Art

In general, an image forming apparatus such as a facsimile, a copying machine or a printer, particularly includes a heat fixing device comprising a ceramics heater that fixes a toner image, which has been formed on a photoreceptor drum, onto a transfer material such as paper by heating and pressurizing the same with a heat roller and a pressure roller, in order to heat-fix the unfixed toner image to a surface of the transfer material. A cylindrical heater is generally employed for fixing such a toner image. FIG. 9 is a model diagram schematically showing the structure of a conventional heat fixing device. As shown in FIG. 9, the heat fixing device comprises a heat roller 25 of aluminum and a pressure roller 8 for coming into pressure contact with the heat roller 25. The cylindrical heat roller 25 is provided therein with a cylindrical heater 20 having a heat source such as a halogen lamp. The heat roller 25 and the pressure roller 8 hold paper 9 provided with a toner image therebetween, thereby fixing the toner image formed on the paper 9. With the heat roller 25, the cylindrical heater 20 rotates along arrow R. The pressure roller 8 also rotates along arrow R. Therefore, the paper 9 held between the heat roller 25 and the pressure roller 8 moves along arrow P.

In the aforementioned case, the cylindrical heater 20 itself rotates to conduct heat to the paper 9 through the heat roller 25, thereby fixing the toner image. Therefore, not only the cylindrical heater 20 but the overall heat roller 25 of aluminum must be heated to a temperature capable of fixing the toner image. Consequently, the heat capacity of the overall heater 20 must be increased, leading to high power consumption.

On the other hand, Japanese Patent Laying-Open Nos. 63-313182 (1988), 1-263679 (1989) and 2-157878 (1990) propose heat fixing devices employing plate heaters having small heat capacities and thin films. FIG. 10 is a model diagram showing a schematic structure of such a heat fixing device employing a plate heater. As shown in FIG. 10, the heat fixing device comprises a heat-resistant resin film 7 consisting of polyimide or the like and a pressure roller 8. The heat-resistant resin film 7 is arranged along a heat roller, to be rotatable. The heat-resistant resin film 7 and the pressure roller 8 rotate along arrows R. Paper 9 provided with a toner image is held between the heat-resistant resin film 7 and the pressure roller 8, to move along arrow P. A plate-type ceramics heater 10 is fixed inside the rotating heat-resistant resin film 7. This ceramics heater 10 comprises an insulating ceramics substrate and a heating element provided thereon. The ceramics heater 10 conducts heat to the paper 9 through the heat-resistant resin film 7. This heat fixes the toner image formed on a surface of the paper 9. Due to the plate shape, the heat capacity of the ceramics heater 10 can be remarkably reduced as compared with a cylindrical heater, whereby power consumption can be reduced.

FIGS. 11A to 11C and 12A to 12C illustrate present mounting structures for the ceramics heater 10 in the heat fixing device shown in FIG. 10. FIG. 11A is a top plan view showing a mounted state of the ceramics heater 10, FIG. 11B is a sectional view taken along the line XIB—XIB in FIG. 11A, and FIG. 11C is an enlarged sectional view showing a part XIC in FIG. 11B. FIG. 12A is a top plan view showing another mounted state of the ceramics heater 10, FIG. 12B is a sectional view taken along the line XIIB—XIIB in FIG. 12A, and FIG. 12C is an enlarged sectional view showing a part XIIC in FIG. 12B.

As shown in FIGS. 11A to 11C, the ceramics heater 10 is supported by a stay 6 of resin serving as a heater base. A plurality of cavities 6*b* are formed on a surface of the stay 6, to be filled up with adhesives 5. The adhesives 5 fix the ceramics heater 10 to the stay 6.

Referring to FIGS. 12A to 12C, on the other hand, a groove 6*c* which is larger in width than the ceramics heater 10 is formed on a surface of a stay 6. This groove 6*c* is provided with two rails 6*a*. The ceramics heater 10 is carried on these rails 6*a*. Adhesives 5 are filled in a plurality of portions between the two rails 6*a*. The adhesives 5 fix the ceramics heater 10 to the stay 6.

In the mounting method shown in FIGS. 11A to 11C, the overall surface of the ceramics heater 10 is in close contact with the surface of the stay 6, except the portions bonded to the stay 6 by the adhesives 5. In the mounting method shown in FIGS. 12A to 12C, on the other hand, the ceramics heater 10 is in close contact with the rails 6*a* of the stay 6.

The heat-resistant resin film 7 slides between the ceramics heater 10 having the aforementioned structure and the pressure roller 8 having a surface of an elastic body (generally rubber) so that the paper 9 provided with the unfixed toner image is fed into a clearance between the heat-resistant resin film 7 and the pressure roller 8 at a constant rate, whereby the toner image is heat-fixed. In recent years, improvement of the throughput of such a heat fixing device is demanded. While the general paper feed rate is about 4 ppm (4 pages per minute: a rate for feeding four sheets of A4 paper under the Japanese Industrial Standards per minute for heat fixing), a higher feed rate of 8 ppm, 16 ppm or 32 ppm is now required.

In order to provide the same heat capacity to the toner image and to attain the same fixation/adhesion strength under a higher feed rate, it is necessary to increase the time for heating the paper, in a simplified way of thinking. To this end, it is necessary to increase the areas of the heating part and the ceramics heater, i.e., the ceramics substrate. In order to cope with the higher feed rate, further, it is necessary to reduce the time for attaining a uniform temperature in a heat soaking part in the ceramics substrate of the ceramics heater in the warm-up (temperature-rise) stage, while maintaining the uniform heating time in the fixing stage. For the purpose of time reduction in the warm-up stage, the inventors have proposed a substrate material of AlN (aluminum nitride) having higher heat conductivity (at least 80 W/mK) than $Al_2O_3$ which is generally employed as the substrate material for a ceramics heater at present. When the substrate material for the ceramics heater is prepared from AlN, the heating element conducts heat to the substrate at an extremely high speed, thereby quickly forming a heat soaking zone on the substrate. It is expected that time reduction in the warm-up stage is thus attained.

In each of the present ceramics heater employing $Al_2O_3$ as the substrate material and the future ceramics heater employing AlN, heat from the ceramics heater is not sufficiently conducted to the paper but mainly absorbed by the base or stay for the ceramics heater, through the substrate when the ceramics heater is mounted on the stay in the conventional manner shown in FIGS. 11A to 11C or 12A to 12C. Thus, the heat cannot be efficiently conducted to the paper and the toner image formed thereon. Particularly in the arrangement shown in FIGS. 11A to 11C, the ceramics heater is in close contact with the stay substantially along the overall surface except the bonded portions, and hence a great quantity of the heat from the ceramics heater is absorbed by the stay. Still in the method shown in FIGS. 12A to 12C, the heat is absorbed by the stay in quantity although heat insulation efficiency is improved due to an air layer defined between the rails for serving as a heat insulating layer.

SUMMARY OF THE INVENTION

An object of the present invention is to provide a structure of a heat fixing device which can improve the thermal efficiency of a ceramics heater.

A heat fixing device according to the present invention comprises a ceramics heater including a heating element which is formed on a ceramics substrate, a heat-resistant film for sliding in close contact with the ceramics heater, and a pressure roller for applying pressure onto the heat-resistant film, for fixing a toner image formed on a surface of a transfer material which is held and moved between the heat-resistant film and the pressure roller by pressurization with the pressure roller and heating with the ceramics heater through the heat-resistant film. The heat fixing device further comprises a base for supporting the ceramics heater and a heat insulating layer formed between the ceramics heater and the base, wherein the heat conductivity of the heat insulating layer is lower than that of the base.

Preferably, the heat conductivity of the heat insulating layer is not more than 0.5 W/mK.

An air layer is interposed between the ceramics substrate and the base for forming the aforementioned heat insulating layer, and the emissivity of the ceramics substrate is preferably higher than that of the base on opposite surfaces thereof.

In this case, the emissivity of the base opposed to the ceramics substrate is preferably suppressed to not more than 0.2, in particular.

Due to the aforementioned heat insulating layer formed between the ceramics heater and the base, it is possible to improve the thermal efficiency of the ceramics heater for reducing the quantity of heat absorbed by the base. Thus, the power consumption of the heat fixing device can be remarkably reduced.

While a common effect is attained due to the provision of the aforementioned heat insulating layer regardless of the material for the ceramics substrate, it is preferable to prepare the material for the ceramics substrate from ceramics having higher heat conductivity in place of $Al_2O_3$ as already proposed by the inventors, in order to reduce the power consumption of the overall heat fixing device while maintaining the fixation quality of the toner image in response to the aforementioned increase of the feed rate for the paper. For example, the substrate material is preferably prepared from ceramics having high heat conductivity such as AlN (aluminum nitride), BN (boron nitride), $Si_3N_4$ (silicon nitride), BeO (beryllium oxide) or SiC (silicon carbide), or a composite ceramics material of a metal, carbon or the like based on such ceramics. Among such ceramics materials, a ceramics material mainly composed of AlN is most preferable in consideration of heat resistance, heat insulation and heat radiation.

It is possible to employ a structure provided with a heating element on a surface of a ceramics substrate opposed to that of a base, by utilizing a ceramics substrate mainly composed of AlN. Due to this structure, the power consumption of the heat fixing device can be further reduced.

When the heating element is formed on the surface of the ceramics substrate opposed to that of the base, the ceramics substrate directly comes into contact with the heat-resistant film. In order to reduce the heat resistance in heat radiation to the heat-resistant film which is directly in contact with the ceramics substrate, the surface roughness of the ceramics substrate is preferably minimized in the part which is directly in contact with the heat-resistant film. Thus, the heat can be smoothly conducted from the ceramics substrate to the heat-resistant film and further therefrom to the surface of the paper, whereby the quantity of heat absorbed by the base can be further reduced. In concrete terms, the surface roughness Ra is not more than 2.0 $\mu$m, preferably not more than 0.5 $\mu$m under the Japanese Industrial Standards.

According to the present invention, as hereinabove described, it is possible to reduce the power consumption of a heat fixing device employing a ceramics heater, thereby contributing to a reduction of the power consumption in a facsimile machine, a copying machine or a printer.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

In a heat fixing device according to the present invention, a heat insulating layer is provided between a ceramics heater and a stay serving as a base. Thus, the heat insulating layer provided between the stay and the ceramics heater provides a heat resistance, whereby the quantity of heat leaking to the stay can be reduced. In concrete terms, the temperature of a heating element provided on a ceramics substrate rises to about 160 to 180° C. for fixation of a toner image. In this case, the temperature of the ceramics substrate provided with the heating element also starts to rise. The heat generated in the ceramics heater increases the temperature of the overall heat fixing device through a heat-resistant film. At this time, a heat soaking part supplied with heat by the ceramics heater in a quantity capable of fixing the toner image on paper is defined between a pressure roller and the heat-resistant film. This heat soaking part fixes the toner image formed on the paper which is fed through a clearance between the pressure roller and the heat-resistant film.

In this process, heat radiation from the heat-resistant film and the pressure roller, which are directly in contact with the paper and the ceramic heater heating the same, to the substrate is unavoidable in a warm-up stage before introduction of the paper, and hence the ceramics heater requires a heat capacity for heat soaking the so-called nip part (heat soaking part) defined between the contact portions of the pressure roller and the heat-resistant film. Therefore, the power necessary for heating these members is decided by the heat capacities of the heated objects and the quantity of heat dissipation to peripheral parts. If the heat capacities of the heated objects are constant, the quantity of heat dissipation must be minimized.

Figure 1A:
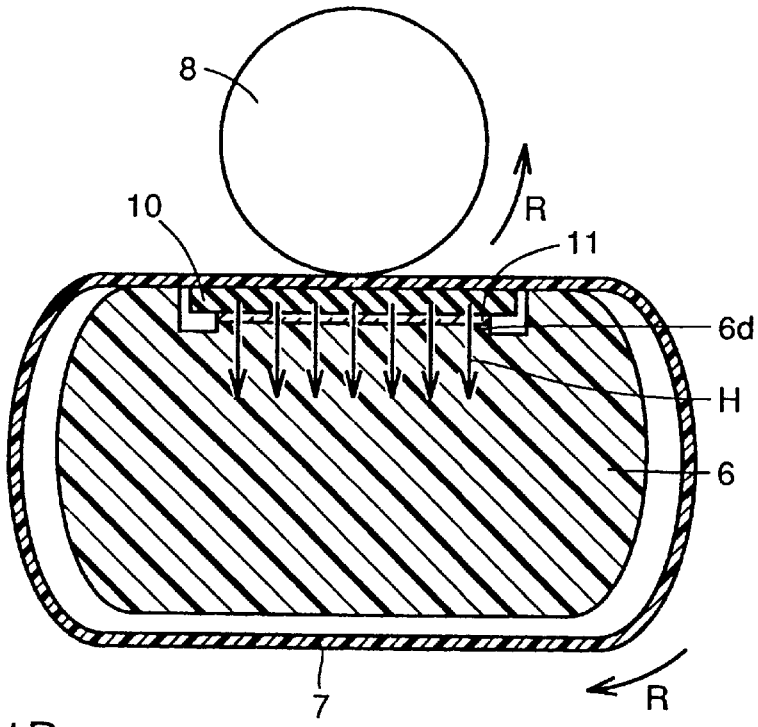
FIGS. 1A and 1B are schematic sectional views showing two exemplary mounting methods for a ceramics heater and a stay according to an embodiment of the present invention.
Figure 1B:
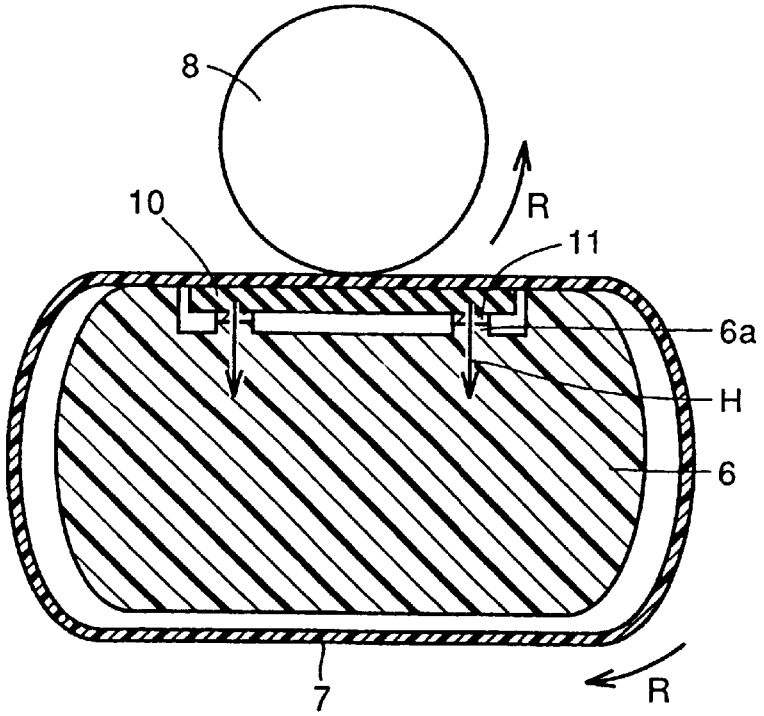

As shown in FIG. 1A, a ceramics heater 10 is mounted on a loading surface 6*d* of a stay 6. In this case, heat from the ceramics heater 10 is dissipated in the stay 6 along arrows H. As shown in FIG. 1B, on the other hand, another ceramics heater 10 is mounted to extend over two rails 6*a* of a stay 6. In this case, heat from the ceramics heater 10 is dissipated in the stay 6 through the two rails 6*a*.

According to the present invention, a heat insulating layer 11 is provided between the ceramics heater 10 and the loading surface 6*d* or the rails 6*a* of the stay 6, as shown in FIG. 1A or 1B. Thus, it is possible to reduce heat leakage from the ceramics heater 10 to the stay 6 through the loading surface 6*d* or the rails 6*a*. Consequently, it is possible to reduce the power to be applied to the ceramics heater 10 before paper is introduced into the heat fixing device.

The heat conductivity of the heat insulating layer 11, which is adapted to inhibit the heat from leaking toward the stay 6, must be lower than that of the stay 6. If the heat conductivity of the heat insulating layer 11 is higher than that of the stay 6, the heat of the ceramics heater 10 is readily transmitted through the heat insulating layer 11 and thereafter conducted to the stay 6. In this case, the heat is disadvantageously discharged from the ceramics heater 10 by the quantity absorbed by the heat insulating layer 11.

In consideration of the above, the heat conductivity of the heat insulating layer 11 is preferably not more than 0.5 W/mK in the present invention, in particular. In order to form the heat insulating layer 11, it is preferable to interpose a heat insulator between contact portions of the ceramics heater 10, i.e. a ceramics substrate provided with a heating element, and the stay 6 while providing an air layer between the ceramics heater 10 and the stay 6 as widely as possible. In the concrete terms, the heat insulator is prepared from heat-resistant resin or ceramics fiber. Due to the aforementioned structure, an air layer having lower heat conductivity than the heat insulator is formed between non-contact portions of the ceramics heater 10 and the stay 6 other than the mounted portions thereof while a heat insulator layer is formed between the mounted portions. In this case, it is preferable to minimize the area of the portion of the ceramics heater 10 mounted on the stay 6 or increase the thickness of the heat insulator layer interposed between the mounted portions, thereby increasing the volume of the space defined between the ceramics heater 10 and the stay 6, i.e. the air layer.

Figure 2A:
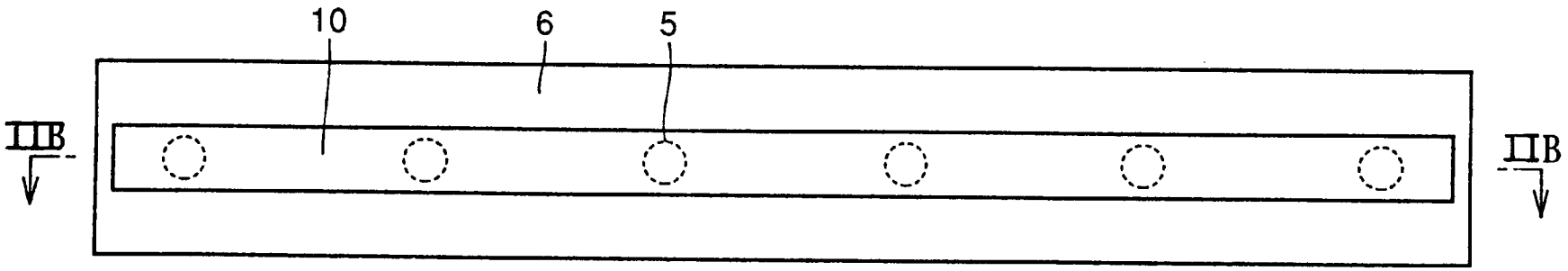
FIG. 2A is a top plan view showing an exemplary mounting structure for further improving heat insulation efficiency in relation to the mounting method shown in FIG. 1A.
Figure 2B:
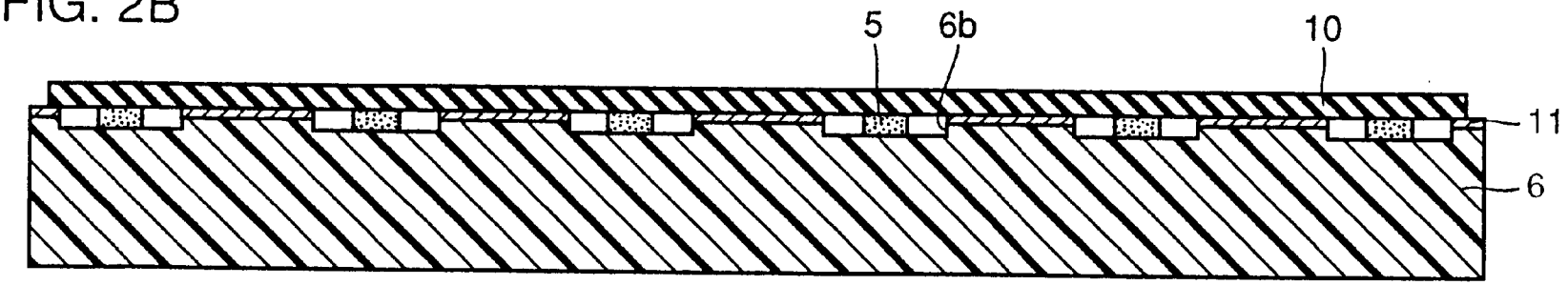
FIG. 2B is a sectional view taken along the line IIB—IIB in FIG. 2A.
Figure 3A:
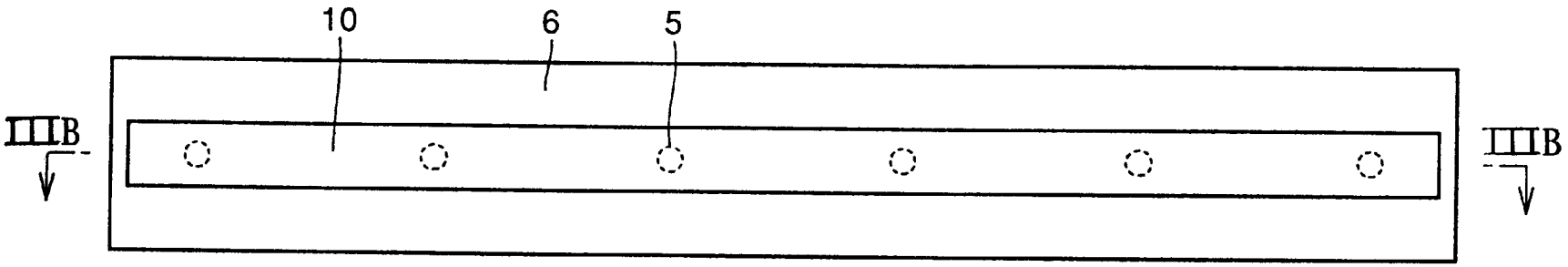
FIG. 3A is a top plan view showing another exemplary structure for further improving heat insulation efficiency in relation to the mounting method shown in FIG. 1A.
Figure 3B:
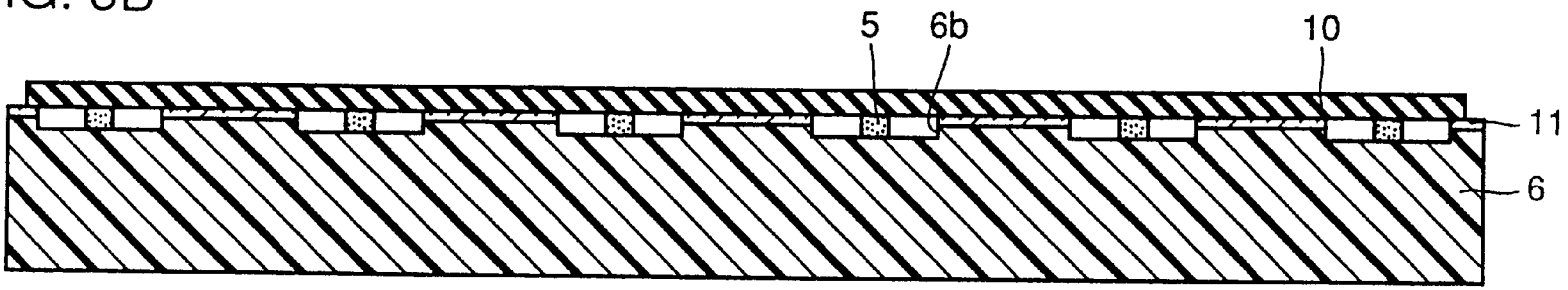
FIG. 3B is a sectional view taken along the line IIIB—IIIB in FIG. 3A.
Figure 11A:
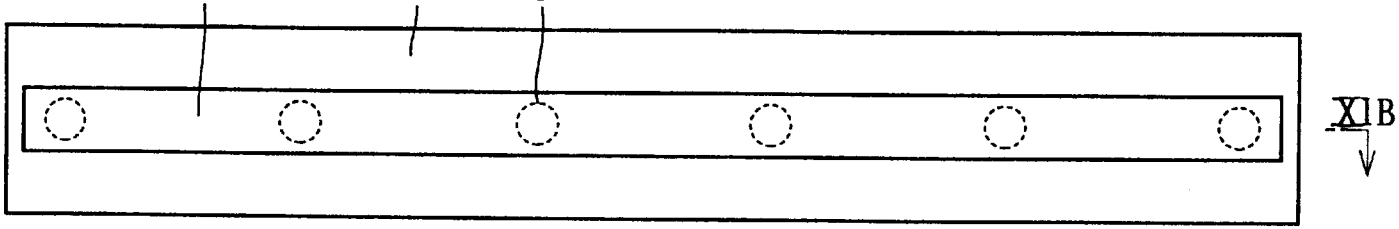
FIG. 11A PRIOR ART
FIG. 11A is a top plan view showing an exemplary conventional mounting structure for a ceramics heater and a stay.
Figure 11B:
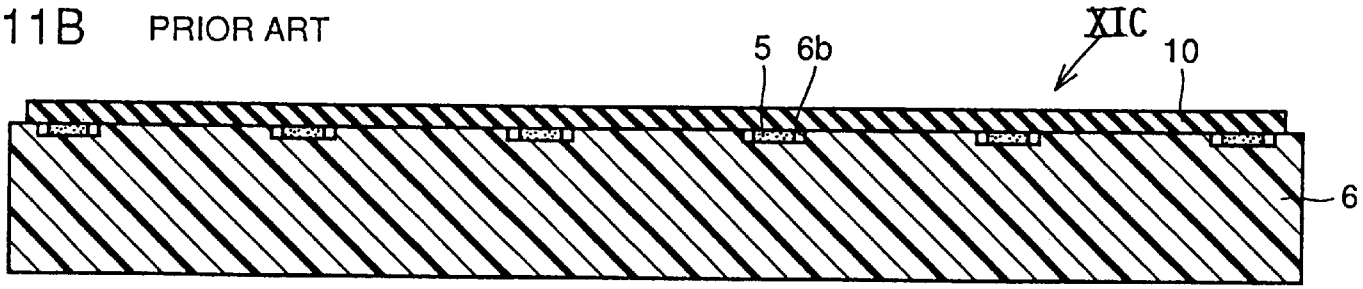
FIG. 11B PRIOR ART
FIG. 11B is a sectional view taken along the line XIB—XIB in FIG. 11A.
Figure 11C:
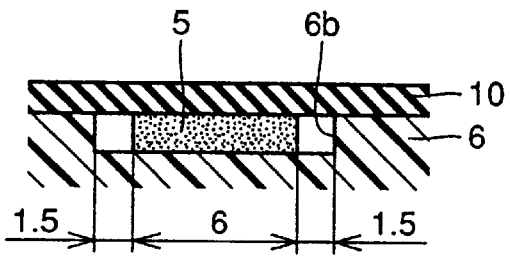
FIG. 11C PRIOR ART
FIG. 11C is an enlarged sectional view showing a part XIC in FIG. 11B.

When the mounting method shown in FIG. 1A is employed, for example, cavities 6*b* shown in FIGS. 2A and 2B are increased in length along a section taken along the line IIB—IIB in FIG. 2A, as compared with those shown in FIGS. 11A to 11C. As shown in FIGS. 3A and 3B, further, the arrangement pattern of adhesives 5 is changed to reduce the areas thereof along a section taken along the line IIIB—IIIB in FIG. 3A, i.e. the lengths of the adhesives 5 within the range allowed by the strength of the ceramics heater 10, i.e. the ceramics substrate. Thus, the volume of the air layer formed between the ceramics heater 10 and the stay 6 can be increased.

Figure 4A:
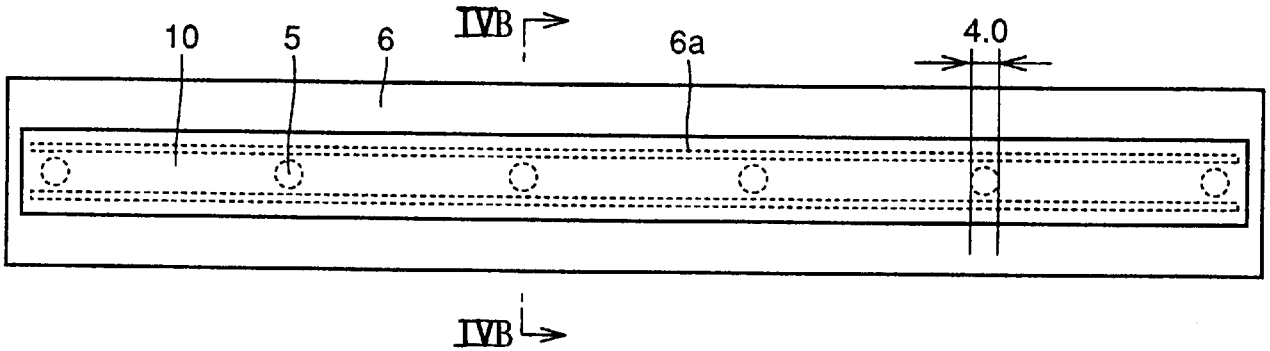
FIG. 4A is a top plan view showing an exemplary structure for further improving heat insulation efficiency in relation to the mounting method shown in FIG. 1B.
Figure 4B:
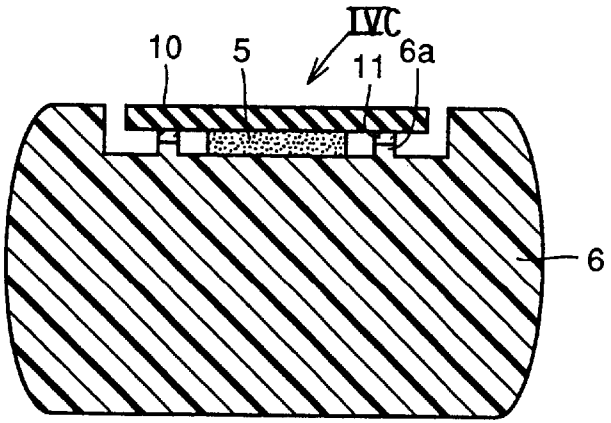
FIG. 4B is a sectional view taken along the line IVB—IVB in FIG. 4A.
Figure 4C:
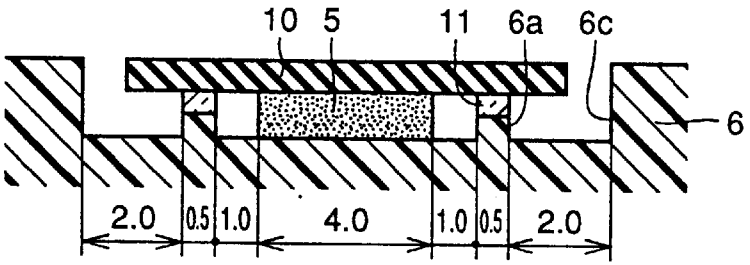
FIG. 4C is an enlarged sectional view showing a part IVC in FIG. 4B.
Figure 5A:
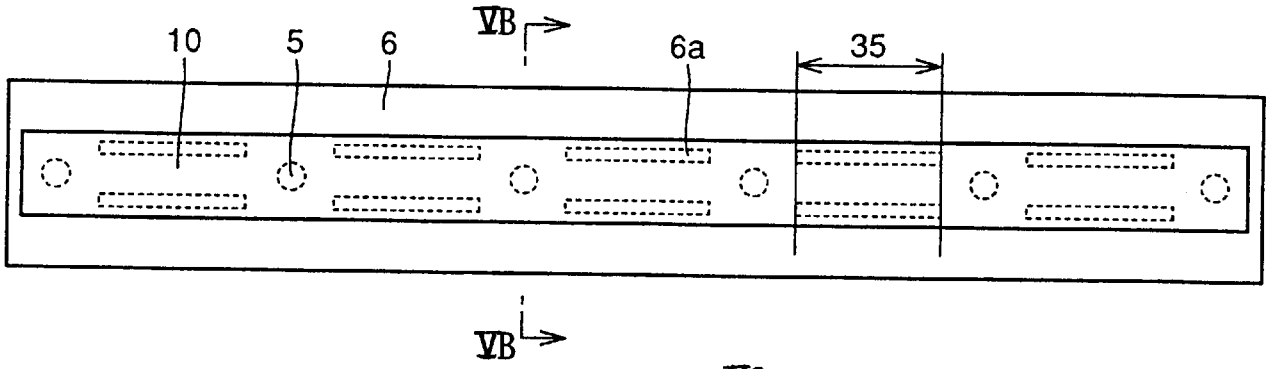
FIG. 5A is a top plan view showing another exemplary structure for further improving heat insulation efficiency in relation to the mounting method shown in FIG. 1B.
Figure 5B:
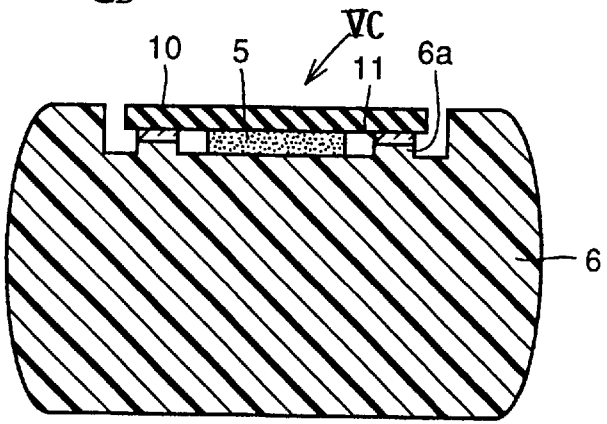
FIG. 5B is a sectional view taken along the line VB—VB in FIG. 5A.
Figure 5C:
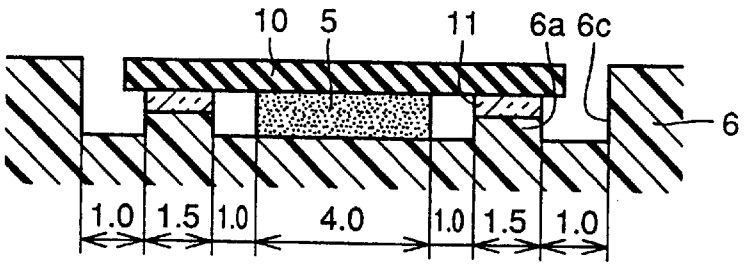
FIG. 5C is an enlarged sectional view showing a part VC in FIG. 5B.
Figure 12A:
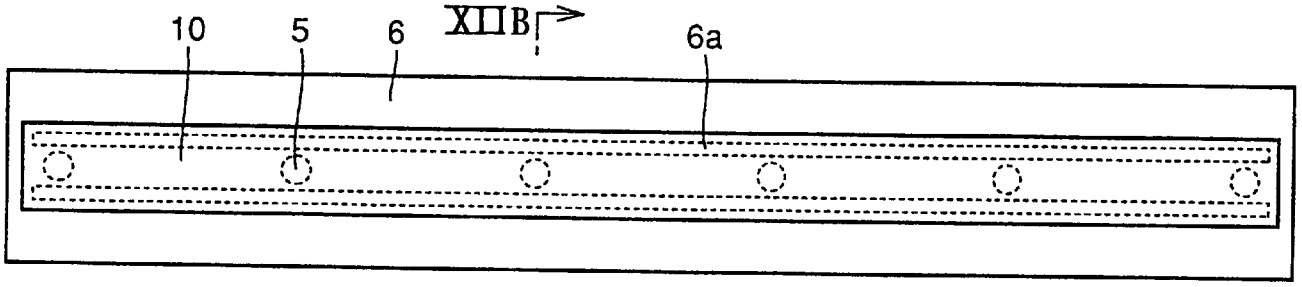
FIG. 12A PRIOR ART
FIG. 12A is a top plan view showing another exemplary conventional mounting structure for a ceramics heater and a stay.
Figure 12B:
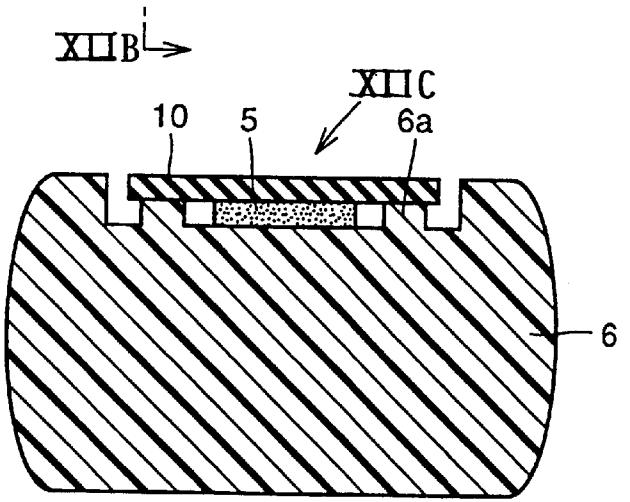
FIG. 12B PRIOR ART
FIG. 12B is a sectional view taken along the line XIIB—XIIB in FIG. 12A.
Figure 12C:
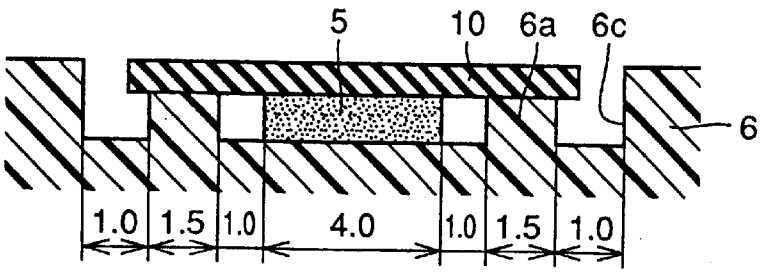
FIG. 12C PRIOR ART
FIG. 12C is an enlarged sectional view showing a part XIIC in FIG. 12B.

When the mounting method shown in FIG. 1B is employed, on the other hand, the rails 6*a* of the stay 6 are reduced in width as compared with those in FIGS. 12A to 12C, as shown in FIGS. 4A to 4C. Further, the rails 6*a* are not formed along the overall length of the stay 6 but intermittently arranged on a groove 6*c* in the range allowed by the strength of the ceramics substrate as shown in FIGS. 5A to 5C, thereby increasing the areas of non-contact portions of the ceramics heater 10 and the stay 6. Thus, the volume of the air layer formed in the space between the ceramics heater 10 and the stay 6 can be increased.

According to the mounting structure for the ceramics heater 10 shown in FIGS. 2A to 3B or 4A to 5C, the contact areas of the ceramics heater 10 and the stay 6 can be reduced as compared with the prior art shown in FIGS. 11A to 11C or 12A to 12C, while the volume of the air layer serving as a heat insulating layer can be increased. Thus, power consumption can be reduced mainly in the warm-up time. The thickness of the heat insulating layer 11 interposed between the mounted portions of the ceramics heater 10 and the stay 6 is preferably maximized, while it has been confirmed by the inventors that a thickness of about 5 mm is conceivably the upper limit in practice.

According to the present invention, the emissivity of the surface of the ceramics heater 10 opposed to the stay 6 is preferably rendered higher than that of the surface of the stay 6 opposed to the ceramics heater 10, for the following reason: The heated ceramics heater 10 emits infrared radiation toward the peripheral space. At this time, the emitted infrared radiation is absorbed or reflected by the peripheral substances. The infrared radiation emitted from the ceramics heater 10 toward the stay 6 is partially absorbed by the stay 6, and partially reflected by the stay 6 toward the ceramics heater 10. The partial infrared radiation absorbed by the stay 6 causes heating of the stay 6, and hence the thermal emissivity of the stay 6 is preferably small. On the other hand, the partial infrared radiation reflected by the stay 6 is absorbed by the substrate forming the ceramics heater 10, or reflected by the same toward the stay 6.

Thus, the surface, which is opposed to the stay 6, of the ceramics substrate forming the ceramics heater 10 preferably absorbs as much infrared radiation as possible so that heat leakage to the stay 6 can be reduced. Therefore, the surface of the ceramics substrate opposed to the stay 6 preferably has high thermal emissivity.

In order to increase the emissivity, the surface roughness of the ceramics substrate may be increased or the surface of the substrate may be covered with a material having high emissivity. The surface roughness of the substrate can be increased by honing or sandblasting. On the other hand, the material having high emissivity can be prepared from commercially available black carbon powder or black body spray. The emissivity of the stay 6 is preferably reduced, in order to reduce the heat energy absorbed by the stay 6. In the concrete terms, the surface of the stay 6 opposed to the ceramics substrate is preferably covered with a material such as Ag or Al having extremely low thermal emissivity. Further, the material for covering the surface of the stay 6 is preferably glossy, in order to further reduce the emissivity. In particular, the emissivity of this surface is further preferably not more than 0.2, so that the stay 6 hardly absorbs heat energy.

In the heat fixing device according to the present invention, the ceramics substrate forming the ceramics heater 10 is preferably made of aluminum nitride. Aluminum nitride is a material extremely readily conducting heat. When the ceramics substrate is prepared from such a material having high heat conductivity, influence by heat leakage from the part of the ceramics substrate which is in contact with the stay 6 is extremely increased. If such heat leakage is reduced according to the present invention, the effect of reducing power consumption is extremely increased.

When the ceramics substrate is prepared from aluminum nitride, further, it is possible to employ the structure in which the heating element is arranged on the surface of the ceramic substrate opposed to that of the stay 6. In the present ceramics heater employing a ceramics substrate prepared from alumina, the heating element is formed on the substrate and covered with an overcoat layer of glass or the like. If the substrate is not more than about 1 mm and the glass layer is about 50 $\mu$m in thickness, heat resistance is reduced in the direction from the heating element toward the ceramics substrate as compared with that from the heating element toward a surface of the glass layer when the substrate is prepared from a material such as aluminum nitride exhibiting high heat conductivity. When the heating element provided on the ceramics substrate is opposed to the stay, the heat resistance is increased along the direction from the heating element to the surface of the glass layer and the stay, thereby advantageously reducing heat leakage toward the stay.

When the heating element is formed on the surface of the ceramics substrate opposed to that of the stay 6, the ceramics substrate directly comes into contact with the heat-resistant film. In this case, the surface roughness Ra of the part of the ceramics substrate which is directly in contact with the heat-resistant film is preferably not more than 2.0 $\mu$m, for the following reason: When the ceramics heater 10 conducts heat onto a surface of paper, the heat conduction between the ceramics substrate and the heat-resistant film is influenced by contact resistance. The heat generated from the heating element provided on the ceramics substrate must be efficiently conducted to the heat-resistant film and the surface of the paper. Therefore, the contact resistance between the heat-resistant film and the surface of the ceramics substrate is preferably as small as possible. In order to minimize the contact resistance, the surface roughness of the ceramics substrate must be reduced. In the concrete terms, the surface roughness Ra of the ceramics substrate is preferably not more than 2.0 $\mu$m, more preferably not more than 0.5 $\mu$m. If the surface roughness Ra of the substrate exceeds 2.0 $\mu$m, the contact resistance between the heat-resistant film and the ceramics substrate is gradually increased to make it difficult to efficiently conduct the heat to the surface of the paper through the heat-resistant film. Namely, the heat is hardly conducted to the heat-resistant film and the surface of the paper, and readily leaks from the parts of the adhesives 5 mounting the ceramics heater 10 on the stay 6 despite the clearance defined therebetween.

EXAMPLE 1

Figure 8A:
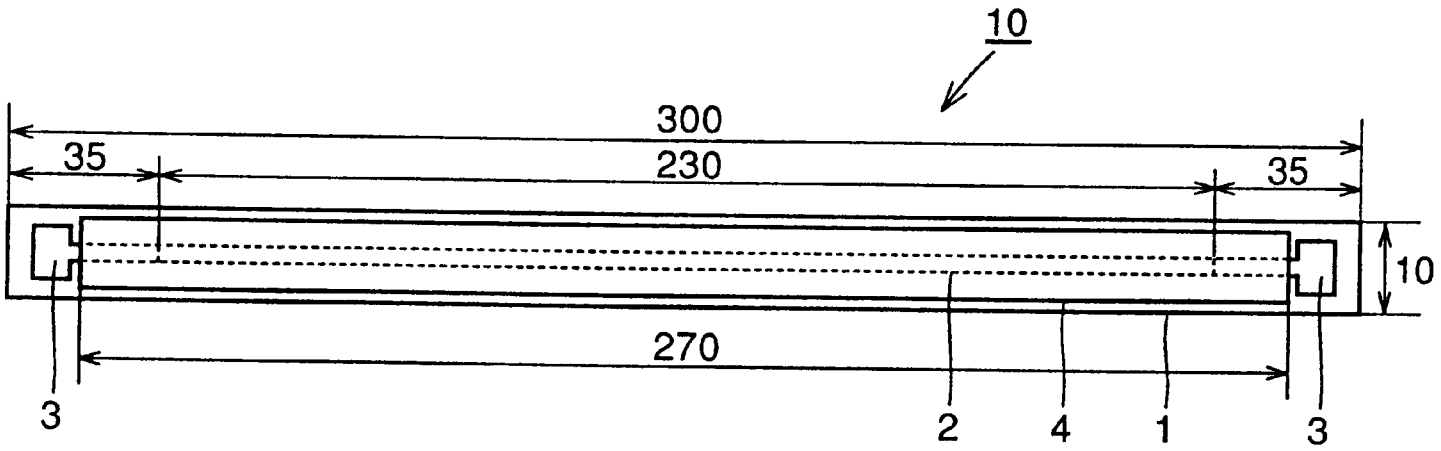
FIG. 8A is a top plan view showing the structure of the ceramics heater employed in each Example in detail.
Figure 8B:
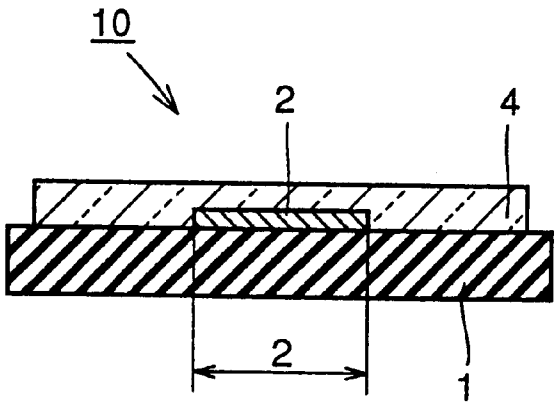
FIG. 8B is a sectional view thereof.
Figure 9:
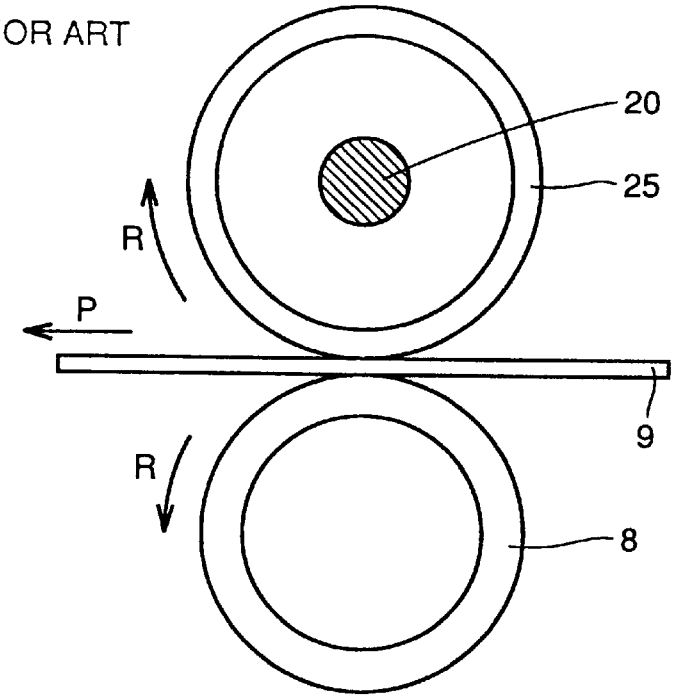
FIG. 9 PRIOR ART
FIG. 9 is a model diagram showing a schematic structure of a conventional heat fixing device provided with a cylindrical heater.
Figure 10:
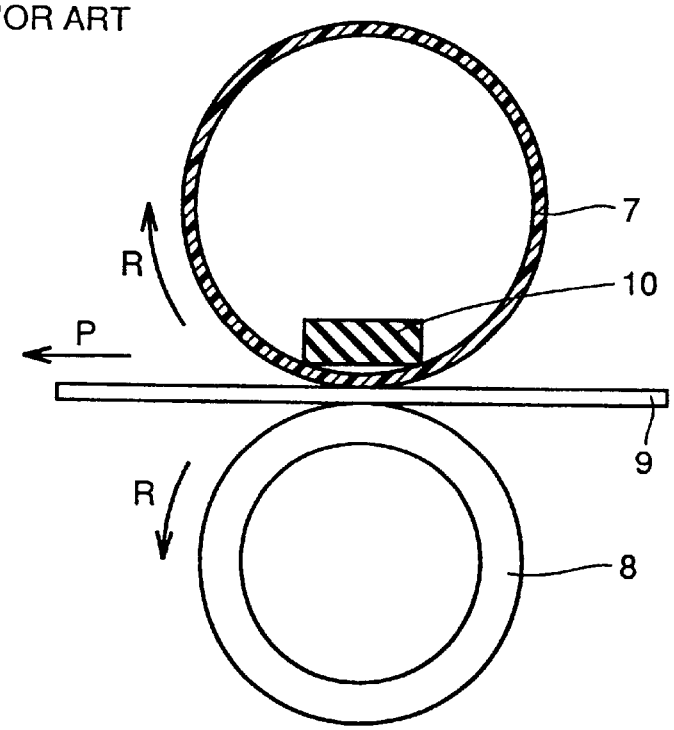
FIG. 10 PRIOR ART
FIG. 10 is a model diagram showing a schematic structure of a conventional heat fixing device provided with a plate-type heater.

A ceramics heater 10 was prepared as shown in FIGS. 8A and 8B. Referring to FIGS. 8A and 8B, all dimensions are in units of millimeters. As shown in FIG. 8A, a ceramics substrate 1 of 300 mm in length, 10 mm in width and 0.635 mm in thickness was prepared. In the concrete terms, 2 parts by weight of $SiO_2$ powder, 2 parts by weight of MgO powder and 2 parts by weight of CaO powder were added to 100 parts by weight of $Al_2O_3$ powder with addition of prescribed quantities of binder and organic solvent, and these materials were mixed with each other in a ball mill. Thereafter a green sheet was prepared by a doctor blade coater. The prepared green sheet was cut into a prescribed size, and the cut sheet was degreased in nitrogen at a temperature of 950° C., and fired in nitrogen at a temperature of 1600° C. After the firing, the sheet was polished into a thickness of 0.635 mm. Thus, the ceramics substrate 1 was prepared.

A heating element 2 and an electrode 3 were printed on the ceramics substrate 1 by screen printing as shown in FIGS. 8A and 8B, and the ceramics substrate 1 was fired in the atmosphere at a temperature of 850° C. At this time, the heating element 2 was prepared from paste mainly composed of Ag—Pd, and the electrode 3 was prepared from paste mainly composed of silver. Then, glaze paste was printed on the heating element 2 by screen printing, and fired in the atmosphere. Thus, a glass layer 4 of 50 μm in thickness was formed on the ceramics substrate 1 in a region of 270 mm in length, as shown in FIGS. 8A and 8B. The thickness or width of the heating element 2 was 2 mm, as shown in FIG. 8B. The length of the heating element 2 was 230 mm, as shown in FIG. 8A.

Such ceramics heaters 10 prepared in the aforementioned manner were mounted on stays 6 consisting of thermosetting phenolic resin, as shown in FIGS. 4A to 4C and 5A to 5C. Referring to FIGS. 4A to 4C and 5A to 5C, all dimensions are in units of millimeters.

In the mounting method shown in FIGS. 4A to 4C, the ceramics heater 10 was carried on rails 6*a* of 0.5 mm in width with interposition of a heat insulator 11 of 0.5 mm in width and 2.0 mm in thickness. The ceramics heater 10 was fixed onto the stay 6 by adhesives 5 of 4.0 mm in diameter, as shown in FIG. 4A. The adhesives 5 were prepared from heat-resistant silicone resin.

In the mounting method shown in FIGS. 5A to 5C, on the other hand, rails 6*a* were intermittently formed on a groove 6*c* of the stay 6 with lengths of 35 mm. The ceramics heater 10 was carried on the stay 6 with interposition of a heat insulator 11 of 1.5 mm in width and 2.0 mm in thickness on the rails 6*a* of 1.5 mm in width. The ceramics heater 10 was fixed to the stay 6 through adhesives 5. The adhesives 5, which were arranged between the intermittent rails 6*a,* were prepared from heat-resistant silicone resin.

For the purpose of comparison, ceramics heaters 10 prepared in the aforementioned manner were carried on stays 6, as shown in FIGS. 11A to 11C and 12A to 12C. Referring to FIGS. 11C and 12C, all dimensions are in units of millimeters.

In the mounting method shown in FIGS. 11A to 11C, cavities 6*b* were intermittently formed along the longitudinal direction of the stay 6. FIG. 11C shows the longitudinal dimensions of the cavities 6*b*. Adhesives 5 filled in the cavities 6*b* fixed the ceramics heater 10 to the stay 6.

In the mounting method shown in FIGS. 12A to 12C, on the other hand, the ceramics heater 10 was carried on a stay 6 to be directly in contact with rails 6*a* of 1.5 mm in width. Adhesives 5 were intermittently filled between the rails 6*a* along the longitudinal direction, thereby fixing the ceramics heater 10 to the stay 6.

Table 1 shows the materials for the heat insulators 11 employed in the above Example. The heating elements 2 exhibited resistance values of 30 Ω.

A heat fixing device was formed by each of the aforementioned stays 6 provided with the ceramics heaters 10, as shown in FIG. 1B. After 15 seconds of supplying power to the ceramics heater 10, unfixed paper provided with toner adhering to its surface was fed into a clearance between a heat-resistant film 7 and a pressure roller 8. The heat conductivity of the stay 6 was 1.0 W/mK, and the paper of A4 size was fed at a feed rate of 4 ppm (15 seconds/sheet). In each heat fixing device, the power consumption required for sufficiently fixing the toner onto the surface of the paper and that required for actual fixation for a single sheet of paper were measured. The power consumption was measured with a watt-hour meter serially connected in a circuit between a power source and the ceramics heater 10. Table 1 shows the results.

TABLE 1

| | Heat Insulator (Material) | Heat Conductivity of Heat Insulator | Power Consumption up to Fixation (Wh) | Power Consumption Required for Fixation (Wh) | Corresponding Figure |
|---|---|---|---|---|---|
| 1 | no | no | 1.25 | 0.52 | FIGS. 11A to 11C |
| 2 | | | 1.18 | 0.50 | FIGS. 12A to 12C |
| 3 | resin (rubber) | 0.5 W/mk | 1.23 | 0.51 | FIGS. 4A to 4C |
| 4 | | | 1.16 | 0.49 | FIGS. 5A to 5C |
| 5 | resin | 1.5 W/mk | 1.30 | 0.54 | FIGS. 4A to 4C |
| 6 | | | 1.22 | 0.52 | FIGS. 5A to 5C |
| 7 | ceramics fiber | 0.06 W/mk | 1.1 | 0.50 | FIGS. 4A to 4C |
| 8 | | | 0.98 | 0.48 | FIGS. 5A to 5C |

From the results shown in Table 1, it is clearly understood that the power consumption can be effectively reduced by mounting the ceramics heater 10 on the stay 6 with interposition of a heat-insulating layer or an air layer.

EXAMPLE 2

Heat fixing devices provided with ceramics heaters having substrates prepared from AlN were evaluated, similarly to Example 1. The samples prepared in Example 2 were identical to those in Example 1, except that the ceramics substrates were formed by aluminum nitride sintered bodies.

Each ceramics substrate was prepared by adding a prescribed quantity of sintering assistant to aluminum nitride powder with addition of prescribed quantities of binder and organic solvent and mixing the materials with each other in a ball mill. Thereafter a green sheet was prepared by a doctor blade coater. The prepared green sheet was cut into a prescribed size, and the cut sheet was degreased in nitrogen at a temperature of 950° C., and fired in nitrogen at a temperature of 1800° C. After the firing, the sheet was polished into a thickness of 0.635 mm, and cut into a ceramics substrate 1 of 300 mm in length and 10 mm in width. A heating element 2 and an electrode 3 were printed on the prepared ceramics substrate 1 by screen printing as shown in FIGS. 8A and 8B, and fired in the atmosphere at a temperature of 850° C. The electrode 3 was prepared from paste mainly composed of silver, and the heating element 2 was prepared from paste mainly composed of Ag—Pd. Thereafter glaze paste was printed on the heating element 2 by screen printing, and fired in the atmosphere. Thus, a glass layer 4 of 50 μm in thickness was formed on a surface of the ceramics substrate 1.

Table 2 shows the values of power consumption measured similarly to Example 1.

TABLE 2

| | Heat Insulator (Material) | Heat Conductivity of Heat Insulator | Power Consumption up to Fixation (Wh) | Power Consumption Required for Fixation (Wh) | Corresponding Figure |
|---|---|---|---|---|---|
| 1 | no | no | 1.15 | 0.52 | FIGS. 11A to 111C |
| 2 | | | 1.08 | 0.50 | FIGS. 12A to 12C |
| 3 | resin (rubber) | 0.5 W/mk | 1.13 | 0.51 | FIGS. 4A to 4C |
| 4 | | | 1.06 | 0.49 | FIGS. 5A to 5C |
| 5 | resin | 1.5 W/mk | 1.28 | 0.54 | FIGS. 4A to 4C |
| 6 | | | 1.21 | 0.52 | FIGS. 5A to 5C |
| 7 | ceramics fiber | 0.06 W/mk | 1.01 | 0.50 | FIGS. 4A to 4C |
| 8 | | | 0.89 | 0.47 | FIGS. 5A to 5C |

From the results shown in Table 2, it is clearly understood that a heat insulating effect can be attained and the power consumption of the heat fixing device can be reduced also in the case of employing aluminum nitride as the material for the ceramics substrate similarly to the case of employing alumina.

EXAMPLE 3

Figure 6A:
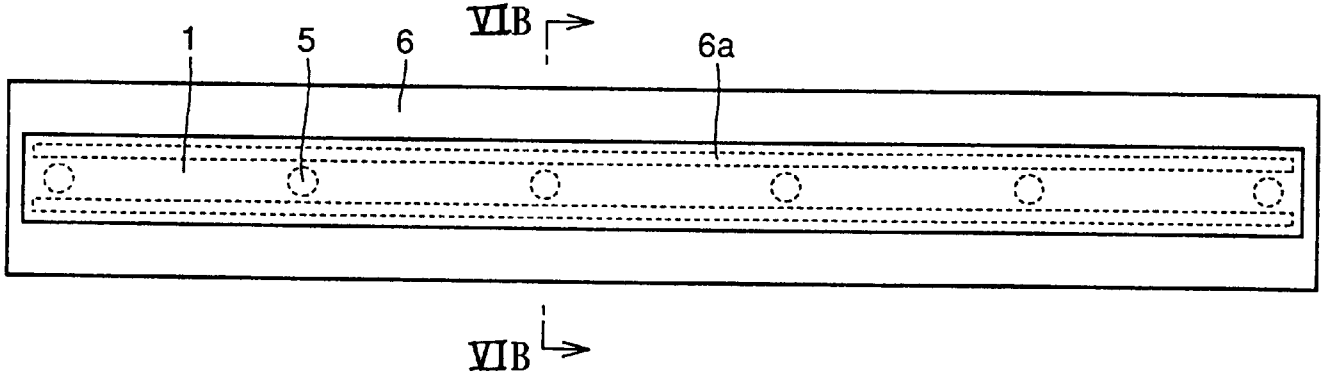
FIG. 6A is a top plan view showing a mounting structure for a ceramics heater and a stay employed in Example 3.
Figure 6C:
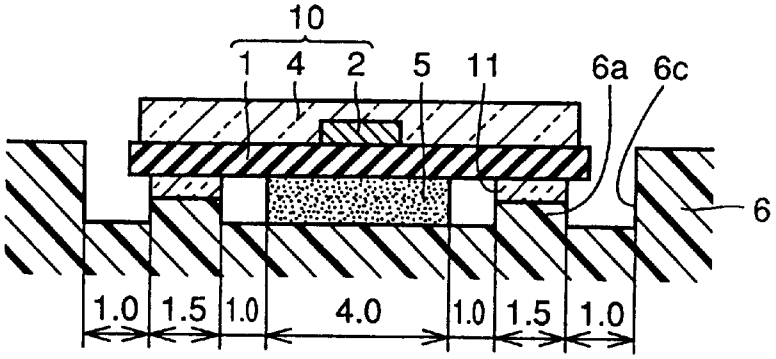
FIG. 6C is an enlarged sectional view showing a part VIC in FIG. 6B.
Figure 6B:
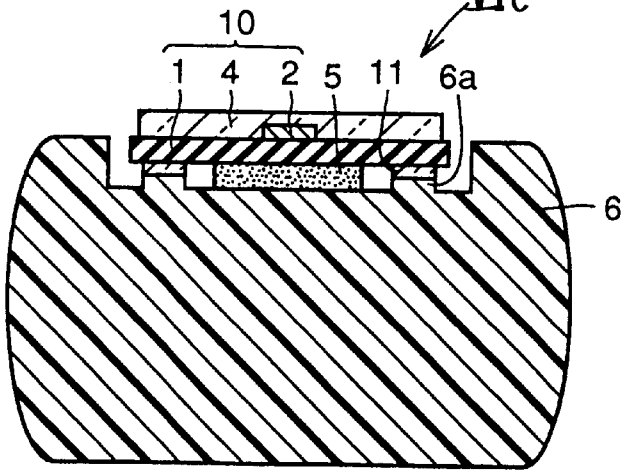
FIG. 6B is a sectional view taken along the line VIB—VIB in FIG. 6A.

Each of ceramics heaters 10 having substrates 1 of alumina and aluminum nitride according to Examples 1 and 2 respectively was mounted on a stay 6, as shown in FIGS. 6A to 6C. Referring to FIG. 6C, all dimensions are in units of millimeters. A heat insulator was 1.5 mm in width and 2.0 mm in thickness. The remaining conditions were similar to those of Examples 1 and 2.

In this Example, the emissivity levels of the stay 6 and the ceramics heater 10 were changed for confirming changes of the power consumption of the ceramics heater 10. The ceramics heater 10 was fixed onto the stay 6, as shown in FIGS. 6A to 6C. The ceramics substrate 1 was supported on rails 6*a,* and a heat insulating layer 11 consisting of ceramics fiber was interposed between the rails 6*a* and the ceramics substrate 1. The ceramics substrate 1 was fixed onto the stay 6 through adhesives 5 consisting of heat-resistant silicone resin.

The emissivity of the ceramics substrate 1 consisting of alumina substrate was 0.85, and that of the ceramics substrate 1 consisting of aluminum nitride was 0.89. The emissivity of each ceramics substrate 1 was increased to 0.95 by spraying carbon powder onto its surface.

On the other hand, the emissivity of the stay 6 consisting of general thermosetting phenolic resin was 0.90. The emissivity of this stay 6 was reduced to 0.17 by covering the overall surface of the stay 6 with aluminum foil between the rails 6*a.*

The emissivity levels of the ceramics substrate 1 and the stay 6 were changed in the aforementioned manner, and the power consumption was measured similarly to Example 1. In this case, the surface roughness Ra of a glass layer 4 shown in FIGS. 6A to 6C was 0.15 $\mu$m.

The power consumption of the ceramics heater 10 was measured while changing the emissivity levels of the ceramics substrate 1 and the stay 6 in the aforementioned manner. Tables 3 and 4 show the results of the measurement as to the ceramics substrates 1 prepared from alumina and aluminum nitride respectively.

TABLE 3

| Emissivity of Substrate | Emissivity of Stay | Power Required up to Fixation (Wh) | Power Required for Fixation (Wh) |
|---|---|---|---|
| 0.85 | 0.90 | 0.98 | 0.48 |
| 0.95 | 0.90 | 0.97 | 0.48 |
| 0.95 | 0.17 | 0.92 | 0.47 |
| 0.85 | 0.17 | 0.93 | 0.47 |

TABLE 4

| Emissivity of Substrate | Emissivity of Stay | Power Required up to Fixation (Wh) | Power Required for Fixation (Wh) |
|---|---|---|---|
| 0.89 | 0.90 | 0.89 | 0.47 |
| 0.95 | 0.90 | 0.87 | 0.47 |
| 0.95 | 0.17 | 0.81 | 0.46 |
| 0.89 | 0.17 | 0.82 | 0.46 |

From the results shown in Tables 3 and 4, it is clearly understood that the power consumption required up to fixation can be reduced by increasing the emissivity of the ceramics substrate 1 and reducing that of the stay 6.

EXAMPLE 4

Figure 7A:
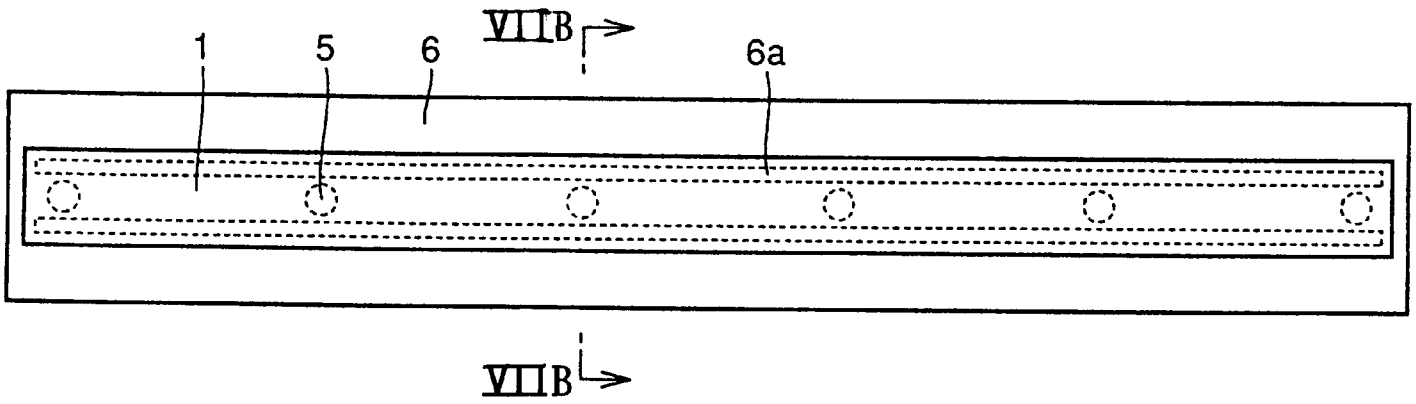
FIG. 7A is a top plan view showing a mounting structure for a ceramics heater and a stay employed in each of Examples 4 and 5.
Figure 7B:
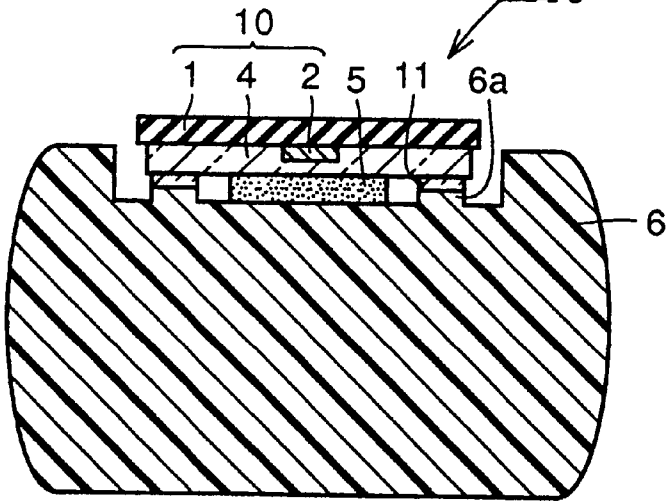
FIG. 7B is a sectional view taken along the line VIIB—VIIB in FIG. 7A.
Figure 7C:
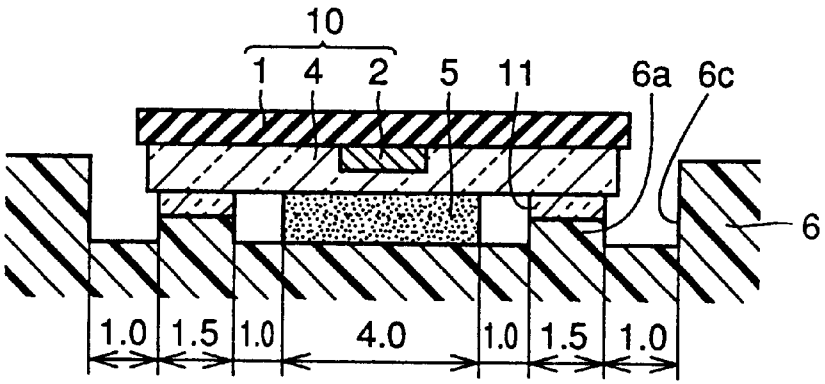
FIG. 7C is an enlarged sectional view showing a part VIIC in FIG. 7B.

Each of ceramics heaters 10 employing alumina and aluminum nitride as substrate materials according to Examples 1 and 2 respectively was mounted on a stay 6, as shown in FIGS. 7A to 7C. While the ceramics heater 10 was so mounted on the stay 6 that the surface of the ceramics substrate 1 was opposed to the stay 6 in Example 3 as shown in FIGS. 6A to 6C, the ceramics heater 10 was mounted on the stay 6 so that a heating element 2 was opposed to a surface of the stay 6 in Example 4. The emissivity of the stay 6 was changed similarly to Example 3, and the power consumption of the ceramics heater 10 was measured.

Table 5 shows the results of measurement in the ceramics heater 10 employing alumina as the substrate material.

TABLE 5

| Emissivity of Substrate | Emissivity of Stay | Power Required up to Fixation (Wh) | Power Required for Fixation (Wh) |
|---|---|---|---|
| 0.85 | 0.90 | 0.98 | 0.48 |
| 0.85 | 0.17 | 0.93 | 0.47 |

It has been recognized that the power consumption cannot be reduced by arranging the heating element 2 to be opposed to the surface of the stay 6 in the ceramics heater 10 employing alumina as the substrate material. This is because the heat resistance of the portion between the heating element 2 and the ceramics substrate 1 is identical to that of the portion between the heating element 2 and the surface of the glass layer 4.

Table 6 shows the results of measurement in the ceramics heater 10 employing aluminum nitride as the substrate material.

TABLE 6

| Emissivity of Substrate | Emissivity of Stay | Power Required up to Fixation (Wh) | Power Required for Fixation (Wh) |
|---|---|---|---|
| 0.89 | 0.90 | 0.85 | 0.48 |
| 0.89 | 0.17 | 0.79 | 0.47 |

In this case, the surface roughness Ra of the ceramics substrate was 0.8 $\mu$m. In the ceramics heater 10 employing aluminum nitride as the substrate material, it was possible to reduce the power consumption by opposing the heating element 2 to the surface of the stay 6. This is because the heat resistance in the portion between the heating element 2 and the surface of the glass layer 4 was higher than that of the portion between the heating element 2 and the ceramics substrate 1.

EXAMPLE 5

A ceramics heater 10 was mounted on a stay 6 as shown in FIGS. 7A to 7C in a method similar to that in Example 1. In this Example, the surface roughness of the ceramics substrate 1 was changed to confirm changes of the power consumption. Table 7 shows the results. The ceramics substrate 1 was prepared from aluminum nitride.

TABLE 7

| Emissivity of Substrate | Emissivity of Stay | Surface Roughness (Ra: $\mu$m) | Power Required up to Fixation (Wh) | Power Required for Fixation (Wh) |
|---|---|---|---|---|
| 0.89 | 0.90 | 2.5 | 0.96 | 0.50 |
| 0.89 | 0.90 | 2.0 | 0.88 | 0.48 |
| 0.89 | 0.90 | 0.5 | 0.86 | 0.46 |
| 0.89 | 0.90 | 0.2 | 0.86 | 0.46 |
| 0.89 | 0.90 | 0.1 | 0.78 | 0.45 |
| 0.89 | 0.17 | 0.5 | 0.81 | 0.46 |
| 0.89 | 0.17 | 0.2 | 0.77 | 0.46 |
| 0.89 | 0.17 | 0.1 | 0.76 | 0.45 |

From the results shown in Table 7, it is clearly understood that an effect of reducing the power consumption is attained when the ceramics substrate 1 is arranged to be directly in contact with a heat-insulating film and the surface roughness Ra of a portion of the ceramics substrate 1 which is in contact with the heat-resistant film is not more than 2.0 $\mu$m, and the power consumption is further reduced when the surface roughness Ra is not more than 0.5 $\mu$m.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A heat fixing device comprising:

a heater including a ceramic substrate and a heating element provided on a first surface of said ceramic substrate;

a heat-resistant film arranged to slide relative to and in contact with said heater;

a base supporting said heater, wherein said heater is arranged with said heating element and said first surface facing toward a second surface of said base, and said heating element is located between said ceramic substrate and said base;

a heat insulating layer that has a lower heat conductivity than said base and that is arranged between at least a first portion of said heater and said base; and a pressure roller arranged on an opposite side of said heat-resistant film relative to said heater and said base, and adapted to apply pressure to said heat-resistant film against said heater while forming a nip adapted to receive a moving transfer material between said pressure roller and said heat-resistant film.

2. The heat fixing device according to claim 1, wherein said ceramic substrate is mainly composed of aluminum nitride.

3. The heat fixing device according to claim 2, wherein said heat conductivity of said heat insulating layer is not more than 0.5 W/mK.

4. The heat fixing device according to claim 2, wherein a gap with an air layer therein is provided between at least a second portion of said heater and said base, wherein a first part of said first surface of said ceramic substrate faces a second part of said second surface of said base across said gap, and wherein said first part of said first surface of said ceramic substrate has a higher emissivity than said second part of said second surface of said base.

5. The heat fixing device according to claim 4, wherein said second part of said second surface of said base has an emissivity of not more than 0.2.

6. The heat fixing device according to claim 5, further comprising a coating comprising black carbon applied on said first part of said first surface of said ceramic substrate.

7. The heat fixing device according to claim 5, further comprising a layer comprising gold or aluminum applied on said second part of said second surface of said base.

8. The heat fixing device according to claim 2, wherein said ceramic substrate of said heater further includes a sliding surface on an opposite side of said ceramic substrate relative to said first surface, and wherein said sliding surface is arranged in direct sliding contact with said heat-resistant film.

9. The heat fixing device according to claim 8, wherein said sliding surface has a surface roughness Ra of not more than 2.0 $\mu$m.

10. The heat fixing device according to claim 8, wherein said sliding surface has a surface roughness Ra of not more than 0.5 $\mu$m.

11. The heat fixing device according to claim 1, wherein said base has a groove therein, said second surface of said base forms a floor of said groove, said base further includes two support rails protruding upwardly from said floor, and said heater is received in said groove and supported on said support rails with said heat insulating layer interposed between said heater and each one of said rails.

12. The heat fixing device according to claim 11, wherein each one of said rails extends continuously along substantially an entire length of said heater, and each one of said rails has a width of 0.5 mm perpendicular to said length.

13. The heat fixing device according to claim 1, wherein said base has a groove therein, said second surface of said base forms a floor of said groove, said base further includes a plurality of rail portions protruding upwardly from said floor and arranged discontinuously along two lines extending parallel to a length of said heater, and said heater is received in said groove and supported on said rial portions with said heat insulating layer interposed between said heater and each one of said rail portions.

14. The heat fixing device according to claim 1, wherein said heater further comprises a glass layer that covers said heating element, substantially covers said first surface of said ceramic substrate, and faces toward said second surface of said base, and further comprising an adhesive that bonds said glass layer to said second surface of said base, and wherein said glass layer is not in contact with said heat-resistant film.

15. The heat fixing device according to claim 1, wherein said ceramic substrate comprises boron nitride.

16. The heat fixing device according to claim 1, wherein said ceramic substrate comprises silicon nitride.

17. The heat fixing device according to claim 1, wherein said ceramic substrate comprises beryllium oxide.

18. The heat fixing device according to claim 1, wherein said ceramic substrate comprises silicon carbide.

* * * * *

UNITED STATES PATENT AND TRADEMARK OFFICE
CERTIFICATE OF CORRECTION

PATENT NO. : 6,049,064

DATED : Apr. 11, 2000

INVENTOR(S) : Natsuhara et al.

It is certified that error appears in the above-identified patent and that said Letters Patent is hereby corrected as shown below:

Col. 6, line 30, after "In", delete "the";

Col. 7, line 42, after "In", delete "the";

Col. 8, line 29, after "In", delete "the";

line 47, after "In", delete "the";

Col. 11, Table 2, under the heading "Corresponding Figure", line 1, replace "111C" by –11C–;

line 45, after "alumina", delete "substrate".

Signed and Sealed this

Twentieth Day of February, 2001

*Attest:*

Nicholas P. Godici

NICHOLAS P. GODICI

*Attesting Officer*

*Acting Director of the United States Patent and Trademark Office*